US006749894B2

(12) United States Patent
Subramanian et al.

(10) Patent No.: US 6,749,894 B2
(45) Date of Patent: Jun. 15, 2004

(54) CORROSION-RESISTANT COATINGS FOR STEEL TUBES

(75) Inventors: Chinnia Gounder Subramanian, Edmonton (CA); David Aaron Easton, Edmonton (CA); Konstantin K. Tzatzov, Sherwood Park (CA); Alexander S. Gorodetsky, Sherwood Park (CA); Andrew George Wysiekierski, Okanagan Falls (CA)

(73) Assignee: Surface Engineered Products Corporation, Fort Saskatchewan (CA)

( * ) Notice: Subject to any disclaimer, the term of this patent is extended or adjusted under 35 U.S.C. 154(b) by 0 days.

(21) Appl. No.: 10/183,342

(22) Filed: Jun. 28, 2002

(65) Prior Publication Data

US 2004/0001966 A1 Jan. 1, 2004

(51) Int. Cl.[7] ..... C23C 30/00; C23C 28/02; C23C 24/00; B05D 7/22

(52) U.S. Cl. ..... 427/239; 427/238; 427/455; 427/383.7; 427/405; 419/8; 148/240; 148/519; 148/527; 148/529; 148/537; 148/590; 148/591

(58) Field of Search ..... 427/455, 456, 427/307, 327, 328, 295, 383.1, 355, 383.3, 383.7, 230, 236, 237, 238, 239, 585, 405; 419/8; 228/193, 199, 203, 262.41; 148/240, 279, 519, 527, 529, 537, 555, 590, 591

(56) References Cited

U.S. PATENT DOCUMENTS

| | | | | |
|---|---|---|---|---|
| 4,878,953 A | | 11/1989 | Saltzman et al. | 148/4 |
| 4,943,489 A | | 7/1990 | Kuhara et al. | 428/586 |
| 5,624,717 A | | 4/1997 | Proner et al. | 427/448 |
| 5,958,332 A | * | 9/1999 | Hoeg | 420/442 |
| 6,093,260 A | * | 7/2000 | Petrone et al. | 148/277 |
| 6,503,347 B1 | * | 1/2003 | Wysiekierski et al. | 148/512 |
| 6,537,388 B1 | * | 3/2003 | Wynns et al. | 148/279 |
| 2002/0192494 A1 | * | 12/2002 | Tzatzov et al. | 428/655 |

FOREIGN PATENT DOCUMENTS

JP 59-001669 * 1/1984

OTHER PUBLICATIONS

British Corrosion Journal by L. Smith, vol. 34, No. 4 (1999) pp. 247–253 "Control of corrosion in oil and gas production tubing." (no month).

Metal Construction 15 (1983) by P. Harris and B.L. Smith, pp. 661–666 (Nov.) "Fuctional Techniques for Weld Quality Prediction".

Proceedings of the Fourth National Thermal Spray Conference, 1991 by G.A. Saltzman and P. Sahoo, pp. 541–548 (May) "Applications of Plasma Arc Weld Surfacing in Turbine Engines".

* cited by examiner

*Primary Examiner*—Michael La Villa
(74) *Attorney, Agent, or Firm*—Arne I. Fors

(57) ABSTRACT

A method of providing a protective, corrosion-resistant thin coating of a MCrX alloy on a carbon or low-alloy steel pipe or tube where M is one of nickel, cobalt or iron or combination thereof and X is one of molybdenum, silicon, tungsten or combination thereof, and heat treating the coating to metallurgically bond the coating onto a steel substrate of the pipe or tube. The coating may be deposited in one or two layers by plasma transferred arc deposition or may be deposited as a slurry coating or thermal spray coating with sintering of the coating. The steel substrate is prepared for coating by at least one of boring, honing, bright finishing, grit blasting, grinding, chemical pickling or electropolishing of the substrate.

32 Claims, 3 Drawing Sheets

CORROSION-RESISTANT COATINGS FOR STEEL TUBES

BACKGROUND OF THE INVENTION (i) Field of the Invention

The present invention relates to a method of coating a steel pipe or tube and, more particularly, relates to a method of providing a protective, corrosion-resistant coating of a metal alloy on a carbon or low alloy steel pipe or tube.

(ii) Description of the Related Art

Downhole oil and gas drilling, production and casing tube strings and tools conventionally are fabricated from carbon steels and low-alloys steels which are prone to corrosion and to erosion under hostile subterranean environments. There accordingly is a need for protective surface coatings on such steel components.

Tubing fabricated from nickel base alloys such as UNS N10276 (ASTM E 527/SAE J 1086) typically are used in deep sour gas production wells having severe corrosion problems from the presence of hydrogen sulfide ($H_2S$), carbon dioxide ($CO_2$) and sodium chloride (NaCl) in the environment. UNS N 10276 alloy, one of the so-called corrosion resistant alloys (CRAs), contains chromium, molybdenum and other alloying elements such as tungsten. As the CRAs are expensive, their use is limited to those wells with very severe corrosion problems where alloy steels or stainless steels are not suitable.

There have been many attempts to produce low-cost corrosion-resistant tubular goods by various methods such as coating, cladding or surface welding, as described by L. Smith in the British Corrosion Journal, Vol. 34, No. 4 (1999) pages 247–253. However, to date there is no commercial product available in the market because of the cost and/or the technical difficulties encountered in the aggressive environment of sour gas fields.

Cladding of steel tubes can be done either by mechanically bonding a thin walled UNS N10276 alloy sleeve to a low alloy steel tube or by metallurgically surface welding the sleeve to the tube. Cladding is a well-known process for covering sheet metal and tubular goods and several clad metals utilizing cladding technology based on different manufacturing processes have been proposed. The various manufacturing processes include simple insertion of a corrosion-resistant liner inside a carbon steel tube and sealing the ends by welding; insertion of a corrosion resistant liner into a carbon steel tube, expanding the liner by pressurized fluid and sealing the ends by welding or by brazing a soldering material between inner and outer tubes; explosive bonding of a corrosion resistant inner sleeve to a carbon steel tube; utilizing hot isostatic pressure to bond an inner tube on outer tube; and shrink-fitting through heating and cooling by utilizing the difference in the thermal expansion coefficients of the inner and outer tube materials (inner tube shrinks less than the outer tube creating interference stress at the interface).

Centrifugal casting, described in the U.S. Pat. No. 4,943,489 (1990), is known for producing a composite pipe. This technique involves pouring a carbon steel in the molten state into a rotary mold to form on outer layer, pouring a corrosion resistant material into the mold after the solidification of the outer layer to create an intermediate layer through reaction between the outer layer and the corrosion resistant material, and continuing pouring the corrosion resistant material to form an inner layer. This method creates a three-layer structure: a 3 mm inner layer, a 20–100 micron intermediate layer and a 15 mm outer layer. This foundry-based process is considered complicated and expensive and thickness control is a problem at low ends.

Powder metallurgy based techniques have been also attempted many times to produce internal coatings inside tubes. The methods involve placing appropriate powder with or without a binder on the internals surfaces of the tubes and sintering using laser, electron beam, plasma source or other appropriate heating mechanisms.

Plasma spraying is a technique also used to coat inside of tubular goods. The inherent porosity of the coating limits its use in corrosion-related applications. Laser remelting of the plasma sprayed coatings appears to help minimize the porosity problems. However, coating of internal surfaces of long tubes with small diameter is a key limitation of this technique.

Plasma transferred arc (PTA), as disclosed for example in U.S. Pat. Nos. 4,878,953 and 5,624,717, is a technique used to apply coatings of different compositions and thickness onto conducting substrates. The material is fed in powder or wire form to a torch that generates an arc between a cathode torch and the substrate work-piece. The arc generates plasma in a plasma plume that heats up both the powder or wire and the surface of the substrate, melting them and creating a liquid puddle, which on solidification creates a welded coating. By varying the feed rate of material, the speed of the torch, its distance to the substrate and the current that flows through the arc, it is possible to control thickness, microstructure, density and other properties of the coating (P. Harris and B. L. Smith, Metal Construction 15 (1983) 661–666). The technique has been used in several fields to prevent high temperature corrosion, including surfacing MCrAlYs on top of nickel based superalloys (G. A. Saltzman, P. Sahoo, Proc. IV National Thermal Spray Conference, 1991, pp 541–548), as well as surfacing high-chromium nickel based coatings on exhaust valves and other parts of internal combustion engines cylinders (Danish Patent 165,125, U.S. Pat. No. 5,958,332).

This technique has been proposed for coating internal surfaces of tubular goods used in oil field applications. The excessive coating thickness has been such that the total cost remained high and rendered the process uneconomic in small and medium tube size ranges.

Key limitations of known PTA process are the inability to deposit thin layers due to large waviness of the deposits, necessitating larger machining allowance and hence thick deposits to obtain smooth surfaces. Excess dilution from the substrate on one hand or lack of bonding on the other hand often results in poor coating.

Other coating techniques reported in the literature include physical vapour deposition (PVD), chemical vapour deposition (CVD) and thermal spraying combined with laser remelting. Some of these surface treatments did not go beyond lab scale testing but others extended to full scale field-testing. However, none of these coatings has been fully adopted by the oil and gas industry notwithstanding the continuing need for corrosion-resistant pipe and tubing in oil- and gas-producing wells.

The apparent lack of interest in these surface-engineered clad tubes results from the high cost of applying the coating with respect to solid wall CRA, lack of satisfactory coating performance due to porosity or similar defects in the coating (e.g. titanium nitride coatings by PVD), and complications in designing connectors for clad tubes.

It is accordingly a principal object of the present invention to provide a method for coating long lengths of steel pipe and tubing, particularly carbon and low alloy steels, with an inexpensive, dense, continuous and smooth protective coating substantially free of defects.

It is another object to provide a corrosion-resistant coating within long lengths of steel pipe and tubing suitable for use in the corrosive environments of oil-and-gas producing wells.

A further object of the present invention is the provision of a thin corrosion-resistant coating metallurgically bonded to the interior of pipes and tubes by plasma transferred arc deposition, or by slurry coating or thermal spraying and sintering.

SUMMARY OF THE INVENTION

In its broad aspect, the method of the invention of providing a protecting coating on a steel substrate comprises metallurgically bonding a continuous thin coating of a MCrX alloy where M=one of nickel, cobalt, iron or combination thereof and X=one of molybdenum, silicon, tungsten or combination thereof, having about 45 to 91 wt % M, about 9 to 40 wt % chromium and 0 to about 20 wt % Mo, 0 to about 20 wt % Si and 0 to about 10 wt % W, by plasma transferred arc deposition of the coating onto the steel substrate or by slurry coating or thermal spraying and sintering. The steel substrate preferably is a plain carbon or low alloy steel and comprises the inner surface of a pipe or tube. The thin alloy coating has a thickness of 0.1 to 10 mm, preferably 0.5 to 5 mm, and most preferably 0.7 to 3 mm.

A preferred MCrX alloy comprises 55 to 65 wt % Ni, 15 to 25 wt % Cr, 10 to 16 wt % Mo, 1 to 4 wt % W and the balance Fe and incidental impurities. The alloy may additionally contain at least one of up to 5 wt % Cu, B, Ti and Nb, up to 1.0 wt % Y, Zr, Ce and C, up to 2 wt % V, up to 4 wt % Ta and up to 0.8 wt % N.

The preferred method comprises preparing the steel substrate by boring, honing, bright finishing, grit blasting, grinding, chemical pickling or electro-polishing the steel substrate prior to deposition of the coating. The preparation of the tube surface prior to deposition determines coating microstructure with acceptable level of porosity. Pre-heating the steel pipe or tube at a temperature in the range of 100 to 800° C., preferably 250 to 600° C., is effective to avoid cracking and to enhance wetting and bonding of the coating to the substrate. The coated pipe or tube preferably is heat treated at a temperature in the range of 800 to 1100° C. for a time effective to restore pre-coating strength, ductility and toughness of the substrate and is smoothed by boring, honing, extruding, drawing, roll-forming, grit blasting, grinding or electro-polishing. A second thin coating of the MCrX alloy having a thickness of about 0.1 to 1.0 mm deposited by plasma transferred arc onto a first continuous thin layer of the MCrX alloy previously deposited by plasma transferred arc provides a smoother coating.

In accordance with another aspect of the invention, the method comprises providing a protective coating on an inner steel substrate of a carbon or low-alloy steel pipe or tube comprising roughening the steel substrate by wet or dry grit blasting, knurling or abrasive cleaning and depositing by slurry coating or thermal spraying a MCrSiX coating powder on the substrate, where M=one of nickel, cobalt, iron or combination thereof and X=one of molybdenum, boron, tungsten or combination thereof, having about 45 to 91 wt % M, about 9 to 40 wt % chromium, about 0.8 to about 20 wt % Si, 0 to about 20 wt % Mo, preferably about 2 to 10 wt % Mo, 0 to about 8 wt % B, preferably 0.8 to about 5 wt % B, and 0 to about 5 wt % W, preferably about 1 to 4 wt % W, and heat treating the coating at a temperature in the range of 600 to 1200° C., preferably in the range of about 950 to 1150° C., for sintering and metallurgically bonding the coating to the substrate.

A preferred MCrSiX alloy in which M=one of nickel, cobalt or combination thereof comprises 45 to 84 wt % M, 15 to 30 wt % Cr, 0.8 to 8 wt % Si, 0.8 to 5 wt % B, 0 to 20 wt % Mo, 0 to 10 wt % W and the balance Fe and incidental impurities. The alloy additionally contains at least one of up to 5 wt % Cu, B, Ti and Nb, up to 1.0 wt % Y, Zr, Ce and C, up to 2 wt % V, up to 4 wt % Ta and up to 0.8 wt % N.

Pipe or tube coating produced according to the method of the invention preferably has a length of 5 to 50 feet, preferably 10 to 46 feet, and more preferably 20 to 46 feet. The coating has a thickness of 0.1 to 5 mm, preferably 0.5 to 3.0 mm, has a sound metallurgically bond with the steel substrate, and has a dense microstructure particularly suitable for pipe or tubing used in oil and gas production.

DESCRIPTION OF THE PREFERRED EMBODIMENTS

Figure 1:
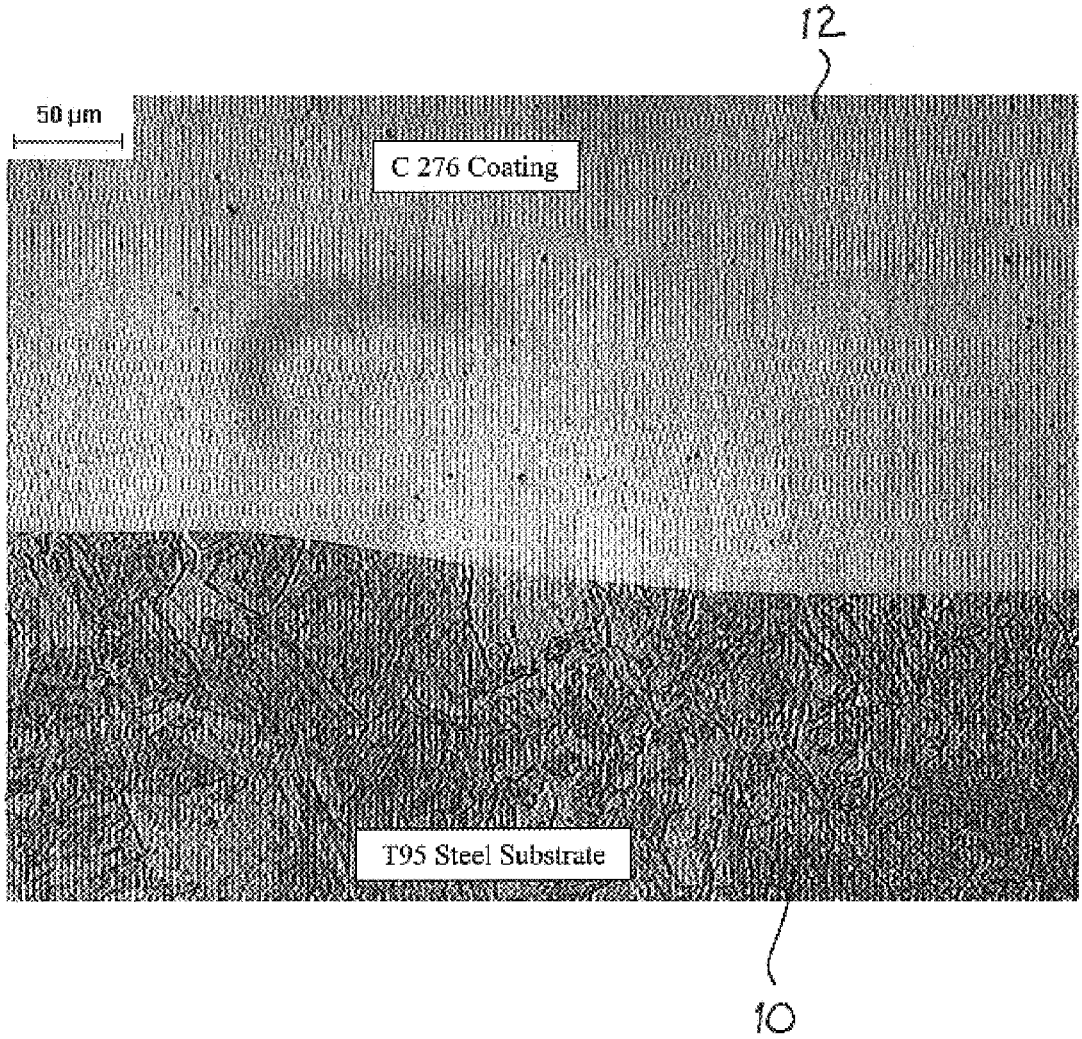
FIG. 1 is a photograph of a microstructure of a coating/alloy interface of an UNS N10276 (C276) coating on a low-alloy steel tube according to the present invention.

A first embodiment of the present invention will be described with reference to FIGS. 1 and 2 of the drawings. A continuous coating of an MCrX alloy is shown deposited onto and metallurgically bonded to a substrate of a carbon steel tube. The MCrX alloy of the invention in which M is a metal selected from the group consisting of iron, nickel and cobalt or mixture thereof and X is an element selected from the group consisting of molybdenum, silicon, tungsten or combination thereof, having about 45 to 91 w % M, about 9 to 40 wt % chromium, and 5 to about 20 wt % Mo, 0 to about 20 wt % Si and 0 to about 5 wt % W. It has been found that the presence of at least one of up to 5 wt %, preferably at least 0.1 wt %, of Cu, B, Ti and Nb, up to 1.0 wt %, preferably at least 0.05 wt %, of Y, Zr, Ce and C, up to 2 wt %, preferably at least 0.1 wt % V, up to 4 wt %, preferably at least 0.1 wt % Ta, up to 20 wt %, preferably at least 1 wt % Mn and up to 0.8 wt %, preferably at least 0.05 wt % N improves coating characteristics such as pitting resistance, austenite stabilization, oxide layer adherence, carbide forming and stabilization, and reactive sintering.

Preferred MCrX alloys are nickel base alloys such as alloys UNS N10276 and UNS N06200 having a general composition of 55 to 65 wt % Ni, 15 to 25 wt % Cr, 10 to 16 wt % Mo, 0 to 5 wt % W and 2 to 5 wt % Fe, and austenitic stainless steel alloys typified by alloy UNS N08825 having 40 wt % Ni, 22 wt % Cr, 3 wt % Mo and 31 wt % Fe.

Steel substrates to be coated by the method of the invention, particularly internal surfaces of pipes and tubes used for oil and gas production, slurry/chemical transportation and the like typically are formed of carbon steels and low-alloy steels. The inner surface to be coated usually is rough as produced and covered with millscale and rust and must be cleaned in order to receive a thin, level, dense coating free of imperfections and defects such as porosity and pin-holes. The inner bore surface of a pipe or tube can be prepared by processes such as boring, honing, bright finishing, grit blasting, grinding, chemical pickling or electro-polishing prior to deposition. The pipe or tube is then pre-heated to a temperature in the range of 100 to 800° C., preferably 250 to 600° C., to avoid cracking and to enhance wetting and bonding of the coating on the substrate.

In a preferred embodiment, a powder of the metal alloy to be coated on the interior of the carbon or low-alloy steel pipe or tube is fed from a hopper at a predetermined rate via an elongated stainless steel tube to a plasma transferred arc torch head inserted into the tube to be coated which is rotated on its longitudinal axis. The transferred arc between the inner surface of the tube and the torch head provides the heat energy in a plasma plume needed to melt the powder and a thin layer of the tube substrate, forming a mixture of the molten metal in a molten pool. This mixing of molten metal leads to metallurgical bonding at the interface of the coating and the substrate. As the tube is rotated, the molten pool moves away from the plasma plume and solidifies. The rate of solidification, which can be controlled by post heating and by the dwell time of the plasma plume, is important to maintain the level of dilution of the coating by the substrate to less than 50%, preferably less than 10% dilution. The torch is cooled by circulating water from a cooler. The power input is controlled by controlling the plasma current and voltage, in addition to pre-heating temperature, powder flow rate, rotational speed and step-over distance.

Once the coating process is completed, the tube is cooled down to room temperature in a controlled manner. Then the tube is subjected to a standard heat treatment cycle appropriate to the substrate-coating system, involving austenitizing at a temperature in the range of 800 to 1100° C., fast cooling by quenching in a suitable medium such as water, oil and polymer mixture, and tempering at a temperature in the range of 200 to 750° C. to obtain the required level of coating hardness and to restore pre-coating strength, ductility and toughness of the steel substrate.

The inner exposed surface of the coating is rough and is finished smooth such as by machining, for example, by boring or honing to a depth of 0.20 to 1.00 mm to render the inner surface smooth. Alternatively, the inner surface can be smoothed by drawing by pressing the inner surface with a metal forming tool which evens out the peaks and troughs. The surface can be further finished by grit or shot blasting, grinding or electro-polishing.

The metal alloy of the coating preferably is deposited in a continuous layer having a thickness of 0.5 to 10 mm, preferably 1.0 to 5.0 mm, and more preferably a thin layer of 0.7 to 3.0 mm. A deterrent to the use of plasma transferred arc deposition has been the high cost of the coating material. It has been found that a dense, uniform coating less than 3 mm in thickness metallurgically bonded to the substrate providing an inexpensive and corrosion-resistant dense coating in long pipes and tubes up to a length of 50 feet, more preferably in a range of 20 to 45 feet, can be effected by plasma transferred arc deposition. A second thin coating of the MCrX alloy having a thickness of about 0.5 to 3 mm deposited by plasma transferred arc onto a first continuous thin layer of the MCrX alloy previously deposited by plasma transferred arc provides a uniformly thick coating.

The coating may be deposited onto the steel surface by a variety of methods including but not limited to physical vapour deposition (PVD), plasma arc-based techniques, thermal spray, and slurry coating techniques with reactive sintering occurring simultaneously with deposition or following deposition. In the case where reactive sintering does not occur during deposition, the overlay coating and substrate are heat-treated subsequently at a soak temperature in the range of about 600 to 1200° C., preferably about 950 to 1150° C. for at least about 10 minutes to initiate reactive sintering.

The MCrSiX alloy coating can be applied to a substrate of carbon steel or low-alloy steel such as tubes and fittings by adding a blended powder of two or more of the MCrSiX constituents to an effective amount of an organic binder, if necessary, and mixed with a solvent combined with a viscous transporting agent to form a slurry and coating the substrate with the slurry. The coated substrate is dried and heated in a vacuum furnace or in an oxygen-free atmosphere for evaporation of the organic binder and for reactive sintering of the coating with the substrate for adhesion of the coating to the substrate.

A preferred slurry composition comprises at least two powder constituents of MCrSiX of which M is nickel. The powder is blended and is added to an organic binder. A portion of the nickel has a relatively smaller average size of 2 to 10 $\mu$m, compared to the average size of 50 to 150 $\mu$m for the remaining constituent or constituents. Some or all of the powder preferably has an angular, irregular or spikey shape compared to the rounded or spherical shape of the remaining constituent or constituents for improved adhesion to the substrate prior to heat-treatment. The inclusion of silicon in the blended powder produces lower melting point constituents during the reaction sintering process, thereby allowing the molten alloy to wet the surface of the substrate and to produce an effective metallurgical bond between the coating and substrate. The coated workpiece is heated to a temperature of at least about 600° C. to 1200° C., preferably about 950 to 1150° C., to initiate reaction sintering of the coating on the workpiece substrate and held at the soak temperature for at least 10 minutes, more preferably about 20 minutes to 24 hours, to provide a continuous impermeable coating metallurgically bonded to the substrate.

The coated and heat-treated samples were characterized for uniformity, metallurgical bond, microstructure density, thickness and composition by standard laboratory techniques using optical microscope and scanning electron microscope with energy dispersive spectroscopy.

The method of the invention and the products produced thereby will now be discussed with reference to the following non-limitative examples.

EXAMPLE 1

UNS N10276 alloy powder was deposited on the inner surface of a carbon steel tube (UNS G 10400 grade) using plasma transferred arc deposition. The current used was 125A and voltage was 26V. The powder was fed at a rate of 18 gpm. The rotational speed of the 3.4 inch diameter tube was 0.6 rpm and the step over distance was 0.25 inch.

Figure 2:
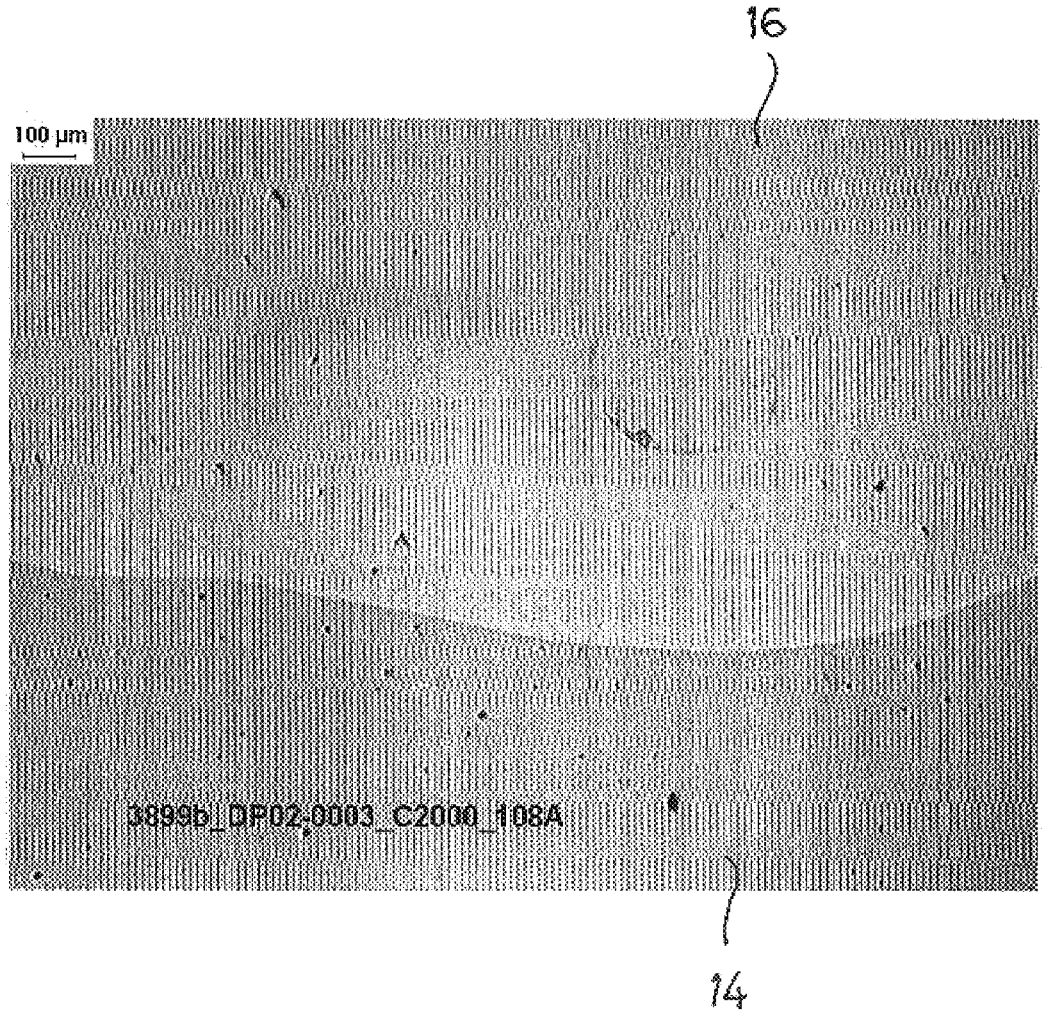
FIG. 2 is a photograph of a microstructure of a coating/alloy interface of an UNS N06200 (C2000) coating on a low-alloy steel tube.

The microstructure shown in the microphotograph of FIG. 1 has a tight metallurgical bond between substrate 10 and coating 12. The coating appears to be dense.

EXAMPLE 2

UNS N06200 powder was deposited on the inner surface of a low-alloy (UNS G 41300 grade) tube of 3.2 inch inner diameter by plasma transferred arc deposition. The current was 108A, the voltage was 26V, the powder was fed at a rate of 18 gpm, tube rotational speed was 0.6 rpm and the step over distance was 0.25 inch. The microstructure shown in the microphotograph of FIG. 2 has a tight metallurgical bond at the interface between the tube substrate 14 and the coating 16. The coating appears to be dense.

EXAMPLE 3

Figure 3:
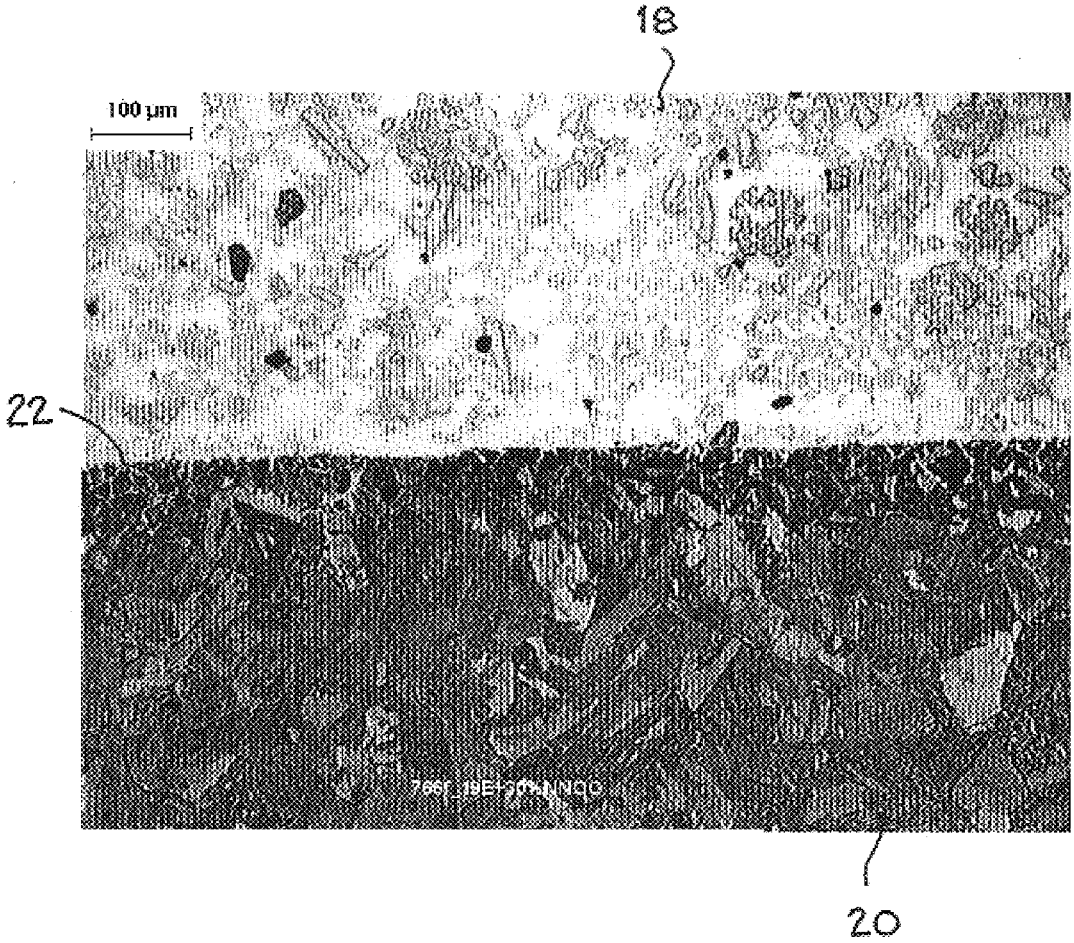
FIG. 3 is a photograph of a microstructure of a nickel base alloy coating on a carbon steel substrate.

A coating of nickel base alloy 18 was deposited on a carbon steel substrate 20 (UNS G10400) using a slurry method. The deposit was dried and then heat-treated under vacuum at 1050° C. for 30 minutes. The thickness of the coating shown in FIG. 3 was over 200 microns. The coating interface 22 shows a metallurgical bonding with the substrate.

It will be understood, of course, that modifications can be made in the embodiments of the invention illustrated and described herein without departing from the scope and purview of the invention as defined by the appended claims.

What is claimed is:

1. A method of providing a protective coating on an inner surface of a steel substrate of a carbon or low-alloy steel pipe or tube comprising preparing the inner surface of the steel substrate by a process that consists of at least one of boring, honing, bright finishing, grit blasting, grinding, chemical pickling or electro-polishing the steel substrate and depositing a continuous thin coating directly on the inner surface of the steel substrate of a MCrX alloy where M=one of nickel, cobalt, iron or combination thereof and X=one of molybdenum, silicon, tungsten or combination thereof, in the amount of about 45 to 91 wt % M, about 9 to 40 wt % Cr and 2 to about 20 wt % Mo, 0.8 to about 20 wt % Si and 1 to about 10 wt % W, and then heat treating the coating to metallurgically bond the coating onto the steel substrate.

2. A method as claimed in claim 1, additionally comprising pre-heating the steel pipe or tube at a temperature in the range of 250 to 600° C. for a time effective to avoid cracking of the coating and to enhance wetting and bonding of the coating.

3. A method as claimed in claim 1 in which the thin coating is MCrSiX deposited by thermal spraying on the inner surface of the steel substrate of a carbon or low-alloy steel pipe or tube having a length of 5 to 50 feet wherein M=one of nickel, cobalt, iron or combination thereof and X=one of molybdenum, boron, tungsten or combination thereof, in the amount of about 45 to 91 wt % M, about 9 to 40 wt % chromium, about 0.8 to about 20 wt % Si, 2 to about 20 wt % Mo, 0.8 to about 8 wt % B and 1 to about 10 wt % W, and heat treating the coating at a temperature in the range of 600 to 1200° C. for sintering and metallurgically bonding the coating to the substrate.

4. A method as claimed in claim 3 in which the pipe or tube has a length of 10 to 46 feet.

5. A method as claimed in claim 4, in which M=one of nickel, cobalt or combination thereof and the MCrSiX alloy consists essentially of about 45 to 84 wt % M, about 15 to 30 wt % Cr, about 0.8 to 8 wt % Si, about 0 to 20 wt % Mo, about 0.8 to 5 wt % B, about 0 to 10 wt % W and the balance Fe and incidental impurities.

6. A method as claimed in claim 5, the MCrSiX alloy additionally comprising at least one of 0.1 to 5 wt % of Cu, B, Ti or Nb; 0.05 to 1.0 wt % of Y, Zr, Ce or C; 0.1 to 2 wt % V; or 0.1 to 4 wt % Ta, 1 to 20 wt % Mn, or 0.05 to 0.8 wt % N.

7. A method as claimed in claim 1, additionally comprising pre-heating the steel pipe or tube at a temperature in the range of 100 to 800° C. for a time effective to avoid cracking of the coating and to enhance wetting and bonding of the coating.

8. A method as claimed in claim 7 in which the continuous thin coating has a thickness of 0.1 to 10 mm.

9. A method as claimed in claim 7 in which the continuous thin coating has a thickness of 0.5 to 5.0 mm.

10. A method as claimed in claim 7 in which the continuous thin coating has a thickness of 0.7 to 3.0 mm.

11. A method as claimed in claim 7 in which the pipe or tube has a length of 10 to 50 feet.

12. A method as claimed in claim 7 in which the pipe or tube has a length of 20 to 46 feet.

13. A method as claimed in claim 7, the MCrX alloy additionally comprising at least one of 0.1 to 5 wt % of Cu, B, Ti or Nb; 0.05 to 1.0 wt % of Y, Zr, Ce or C; 0.1 to 2 wt % V; or 0.1 to 4 wt % Ta, 1 to 20 wt % Mn, or 0.05 to 0.8 wt % N.

14. A method as claimed in claim 7 in which the thin coating is deposited by plasma transferred arc deposition.

15. A method as claimed in claim 14 additionally comprising smoothing the coated substrate by boring, honing, extruding, drawing, roll-forming, grit blasting, grinding, heat polishing or electro-polishing the coated substrate.

16. A method as claimed in claim 14, additionally comprising smoothing the coated substrate by depositing a second thin coating of said MCrX alloy having a thickness of 1.0 to 1.0 mm by plasma transferred arc onto the first continuous thin coating.

17. A method as claimed in claim 14, in which the MCrX alloy consists essentially of about 55 to 65 wt % Ni, about 15 to 25 wt % Cr, about 10 to 16 wt % Mo, about 1 to 4 wt % W and the balance Fe and incidental impurities.

18. A method as claimed in claim 17, additionally comprising smoothing the coated substrate by depositing a second thin coating of said MCrX alloy having a thickness of 0.1 to 1.0 mm by plasma transferred arc onto the first continuous thin coating.

19. A method as claimed in claim 14 in which the coated steel pipe or tube is heat treated at a temperature in the range of 800 to 1100° C., water quenched, and tempered at a temperature in the range of 200 to 750° C. for a time effective to restore pre-coating strength, ductility and toughness of the steel substrate.

20. A method as claimed in claim 19 additionally comprising smoothing the coated substrate by boring, honing, extruding, drawing, roll-forming, grit blasting, grinding, heat polishing or electro-polishing the coated substrate.

21. A method as claimed in claim 14 in which the continuous thin coating consists essentially of 40 wt % Ni, 22 wt % Cr, 3 wt % Mo and 31 wt % Fe.

22. A method of providing a protective coating on an inner surface of a steel substrate of a carbon or low-alloy steel pipe or tube by a method comprising roughening the inner surface of the steel substrate by a process that consists of wet or dry grit blasting, knurling or abrasive cleaning and then depositing a continuous thin coating of a MCrSiX coating powder directly on the inner surface of the steel substrate, where M=one of nickel, cobalt, iron or combination thereof and X=one of molybdenum, boron, tungsten or combination thereof, in the amount of about 45 to 91 wt % M, about 9 to 40 wt % chromium, about 0.8 to about 20 wt % Si, 2 to about 20 wt % Mo, 0.8 to about 8 wt % B and 1 to about 10 wt % W, and then heat treating the coating at a temperature in the range of 600 to 1200° C. for sintering and metallurgically bonding the coating to the inner surface of the steel substrate.

23. A method as claimed in claim 22 in which the coating is heat treated at a temperature in the range of 950 to 1150° C. for sintering and metallurgically bonding the coating to the substrate.

24. A method as claimed in claim 22, wherein M is nickel, depositing said coating powder by blending die coating powder with a liquid organic binder to form a slurry, coating the substrate with the slurry and evaporating the organic binder prior to sintering the coating.

25. A method as claimed in claim 22 additionally comprising smoothing the coated substrate by boring, honing, extruding, drawing, roll-forming, grit blasting, grinding, heat polishing or electro-polishing the coated substrate.

26. A method as claimed in claim 22 in which the continuous thin coating has a thickness of 0.1 to 5 mm.

27. A method as claimed in claim 22 in which the continuous thin coating has a thickness of 0.5 to 3.0 mm.

28. A method as claimed in claim 22 in which the pipe or tube has a length of 10 to 50 feet.

29. A method as claimed in claim 22 in which the pipe or tube has a length of 20 to 46 feet.

30. A method as claimed in claim 22 in which M=one of nickel, cobalt or combination thereof and the MCrSiX alloy consists essentially of about 45 to 84 wt % M, about 15 to 30 wt % Cr, about 0.8 to 8 wt % Si, about 2 to 20 wt % Mo, about 0.8 to 5 wt % B, about 1 to 10 wt % W and the balance Fe and incidental impurities.

31. A method as claimed in claim 22, MCrSiX alloy additionally comprising at least one of 0.1 to 5 wt % of Cu, B, Ti or Nb; 0.05 to 1.0 wt % of Y, Zr, Ce or C; 0.1 to 2 wt % V; or 0.1 to 4 wt % Ta, 1 to 20 wt % Mn, or 0.05 to 0.8 wt % N.

32. A method as claimed in claim 24, wherein some or all of the powder has an angular, irregular or spikey shape.

* * * * *